US008479697B2

(12) United States Patent
Volland et al.

(10) Patent No.: US 8,479,697 B2
(45) Date of Patent: Jul. 9, 2013

(54) GLOW PLUG HAVING COKING-OPTIMIZED DESIGN

(75) Inventors: Karsten Volland, Ludwigsburg (DE); Bernd Last, Reutlingen (DE); Hans Houben, Würselen (DE); Dirk Von Hacht, Grossbottwar (DE); Frank Pechhold, Ludwigsburg (DE); Christian Pottiez, Eppingen (DE); Michael Haussner, Benningen (DE); Ralf Ehlert, Stuttgart (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 390 days.

(21) Appl. No.: 12/678,736

(22) PCT Filed: Aug. 21, 2008

(86) PCT No.: PCT/DE2008/001372

§ 371 (c)(1),
(2), (4) Date: May 10, 2010

(87) PCT Pub. No.: WO2009/036724

PCT Pub. Date: Mar. 26, 2009

(65) Prior Publication Data

US 2010/0236512 A1 Sep. 23, 2010

(30) Foreign Application Priority Data

Sep. 19, 2007 (DE) ..... 10 2007 044 967

(51) Int. Cl.
*A01H 5/02* (2006.01)
*F02B 9/10* (2006.01)
*F23Q 7/00* (2006.01)
*F23Q 7/22* (2006.01)

(52) U.S. Cl.
USPC ..... 123/145 R; 219/270; 219/260

(58) Field of Classification Search
USPC ..... 123/543, 549, 145 R; 219/260, 270
See application file for complete search history.

(56) References Cited

U.S. PATENT DOCUMENTS

| | | | | |
|---|---|---|---|---|
| 4,620,516 | A | 11/1986 | Reuem et al. | |
| 5,664,547 | A | 9/1997 | Klak et al. | |
| 6,314,930 | B1 * | 11/2001 | Eller et al. | 123/145 A |
| 7,581,520 | B2 * | 9/2009 | Kern et al. | 123/145 A |
| 2006/0053875 | A1 | 3/2006 | Haussner et al. | |
| 2007/0228030 | A1 * | 10/2007 | Boucard et al. | 219/270 |
| 2008/0028841 | A1 | 2/2008 | Ludwig et al. | |
| 2008/0296281 | A1 | 12/2008 | Glock et al. | |
| 2008/0302323 | A1 | 12/2008 | Kern et al. | |
| 2009/0026889 | A1 | 1/2009 | Wolfer et al. | |
| 2009/0169900 | A1 | 7/2009 | Oberle et al. | |
| 2009/0314061 | A1 | 12/2009 | Kern et al. | |

FOREIGN PATENT DOCUMENTS

| | | | |
|---|---|---|---|
| DE | 103 46 295 | A1 | 4/2004 |
| DE | 10 2005 042 667 | A1 | 3/2007 |
| WO | WO 2005111503 | A1 * | 11/2005 |
| WO | WO 2006072510 | A1 * | 7/2006 |

* cited by examiner

*Primary Examiner* — Stephen K Cronin
*Assistant Examiner* — Sherman Manley

(57) ABSTRACT

Glow plug, particularly for operation in a combustion engine, comprising at least one heating rod (1) and at least one body (2) and at least one annular gap (3) between the heating rod (1) and the body (2) and at least one chamber (4) primarily arranged between the heating rod (1) and the body (2).

1 Claim, 8 Drawing Sheets

GLOW PLUG HAVING COKING-OPTIMIZED DESIGN

The invention relates to a glow plug. Such glow plugs are known, e.g. from DE 10346295. A disadvantage of such glow plugs is that carbonization takes place between the heating rod and the cylinder head and inside the annular gap during the normal operation of the glow plugs in a combustion engine. This leads to problems at the time of demounting glow plugs or pressure sensor glow plugs that are mounted in the cylinder head and also regarding the conduction of heat to or in the glow plug.

The object of this invention is to eliminate these disadvantages and to create a glow plug, which allows an operation of the combustion engine free from carbonization and/or prevents a carbonization of the glow plug in the cylinder head or in the annular gap of the glow plug.

This object is achieved with a glow plug described in claim 1. Here, an advantage is that the invention puts forth a design that ensures a reliable gas exchange, which in turn ensures complete oxidation at the contact points of the cylinder head/glow plug or the body/heating rod and prevents the accumulation of carbon.

This design of the annular gap and the free space prevents carbonization of the glow plugs in the cylinder head hole between the heating rod and cylinder head permanently. As a result, the thermal profile and thermal properties of the glow plug remain unchanged throughout its life time. In case of moving heating rods, the mobility remains unchanged throughout the life time of the glow plug.

A complicated process of demounting or a subsequent damage resulting from a possible carbonization and a top high demounting torque can be reliably avoided. Beneficial embodiments and further developments of the invention are described in the sub-claims.

BRIEF DESCRIPTION OF THE DRAWINGS

The invention is explained in detail below with the help of drawings.

In the figures.

DETAILED DESCRIPTION

Figure 1:
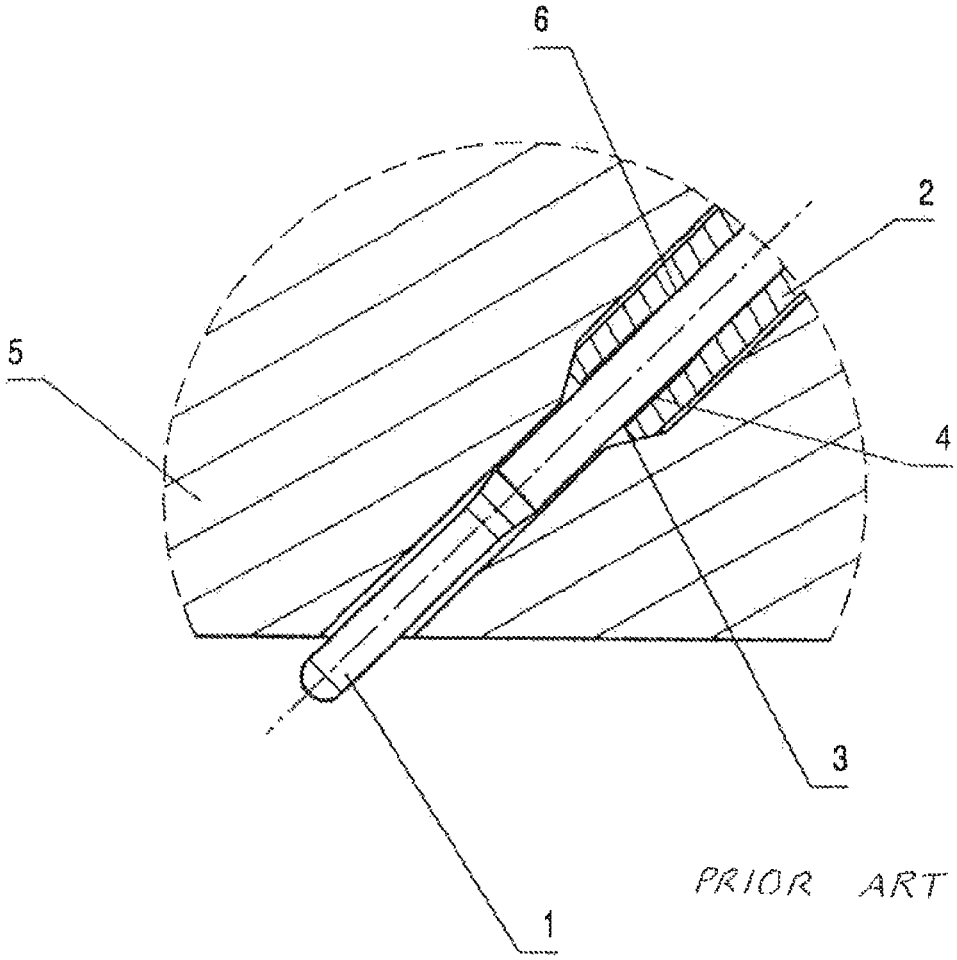
FIG. 1: shows the installation situation of the glow plug with volume in the cylinder head as per prior art.
Figure 2:
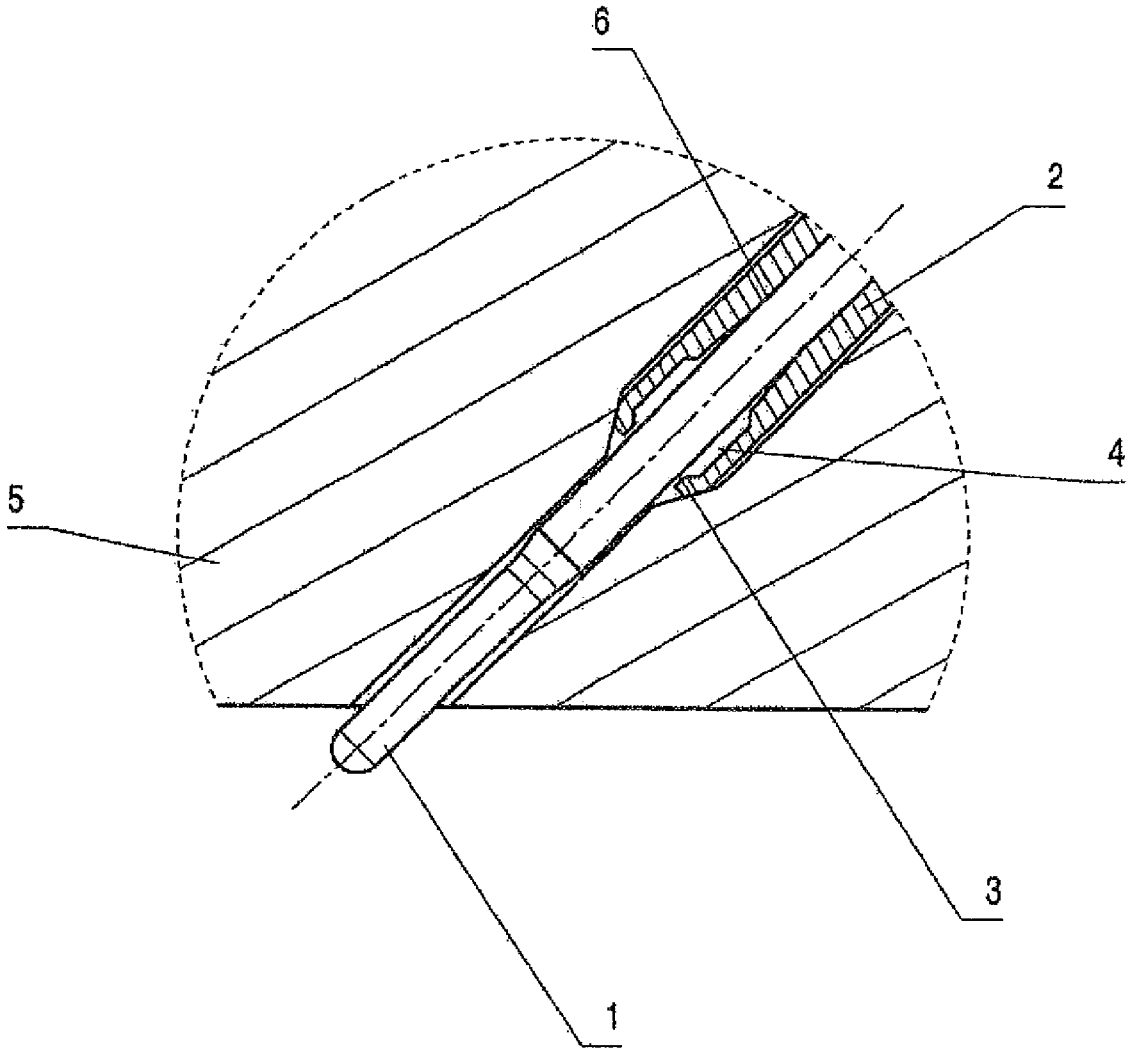
FIG. 2: shows the installation situation of the glow plug with varied volume

FIG. 2 shows a glow plug located in a cylinder head 5 with an annular gap 3 between the heating rod 1 and the body 2 of the glow plug. A chamber 4 is adjacent to the annular gap 3, which communicates with the combustion chamber of the combustion engine through the annular gap 3 in such a way that oxygen containing gas reaches the chamber 4. By means of this annular gap 3 and the empty space 4 there is a possibility of a volume flow from the combustion chamber of the combustion engine into the chamber 4. This ensures a reliable gas exchange and thereby provides for a sufficient quantity of oxygen in the area of contact surfaces between the cylinder head and the glow plug. Thus, very high temperatures are reached in the annular gap 3 and the space 4 due to oxidative processes. These high temperatures burn the carbon in this area and as a result, the carbon does not get deposited in this area that is relevant for a smooth operation of the combustion engine.

Because of the design of the annular gap 3 according to this invention, the volume flow and thereby the gas exchange can be set in such a way that there are no carbon deposits.

What is important is that a sufficient proportion of oxygen reaches the annular gap 3 and thus, supports or enables the process of complete combustion.

This possibility of gas exchange also leads to an increase in the temperature in the annular gap between the cylinder head 5 and the heating rod 1.

Figure 6:
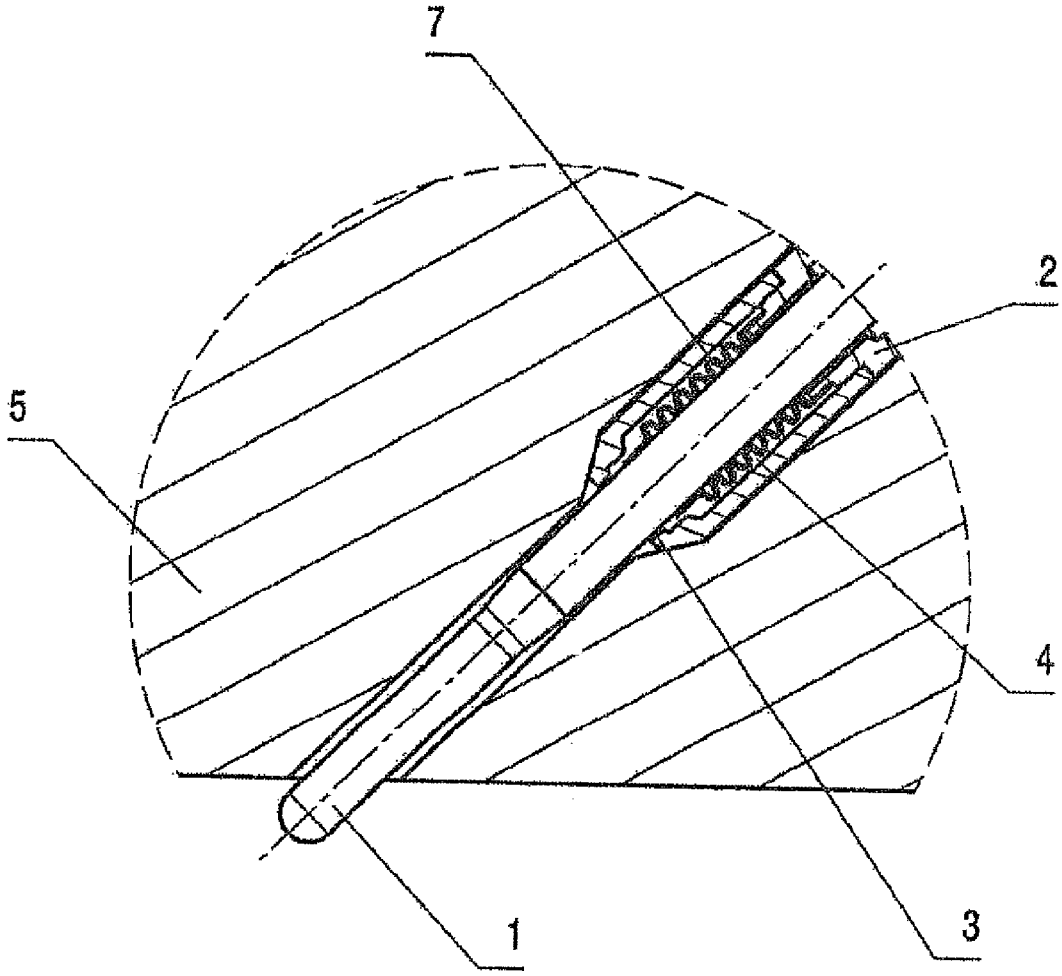
FIG. 6: shows the installation situation of a pressure sensor glow plug with volume

In applications, in which a mobile heating rod 1 is used, as shown in FIG. 6, this combination of annular gap 3 and empty space 4 is meant for retaining the mobility of the heating rod 1.

With a defined annular gap 3 and the corresponding empty space 4, an appropriate volume can be reached, which is nearly 140 $mm^3$ in a particularly advantageous design so as to facilitate a sufficient flow of the combustion gas.

The defined annular gap 3 and the corresponding empty space 4, which allows a defined volume (as described above) for the gas exchange during a combustion process, is based on the principle of the so-called Helmholtz resonator.

It has a gas volume with a narrow opening and an annular gap 3 leading outwards. The elasticity of the air volume inside coupled with the inert mass of the air in the opening leads to a mechanical mass-spring-system with a marked self-resonance.

The value of the correction element for the boundaries of the pipe is only half of the value given in the following formula:

$$f = \frac{c}{2 \cdot \pi} \sqrt{\frac{\pi \cdot r^2}{V \cdot (l + \pi r/2)}}$$

c: Acoustic velocity

V: Volume of the hollow body r: Radius of the pipe l: Length of the pipe

Correction element for the pipe boundary: $+\pi r/4$

Since the boundary between the gas areas, which act as mass or spring, is blurred, it is difficult to calculate the exact frequency of a Helmholtz resonator.

Approximation formula for calculating the resonance frequency:

$$fb = \sqrt{\frac{3000A}{Vl + 0,846V\sqrt{A}}}$$

l: Length of the tunnel

A: Surface of the tunnel

V: Inner volume of the box

Figure 5:
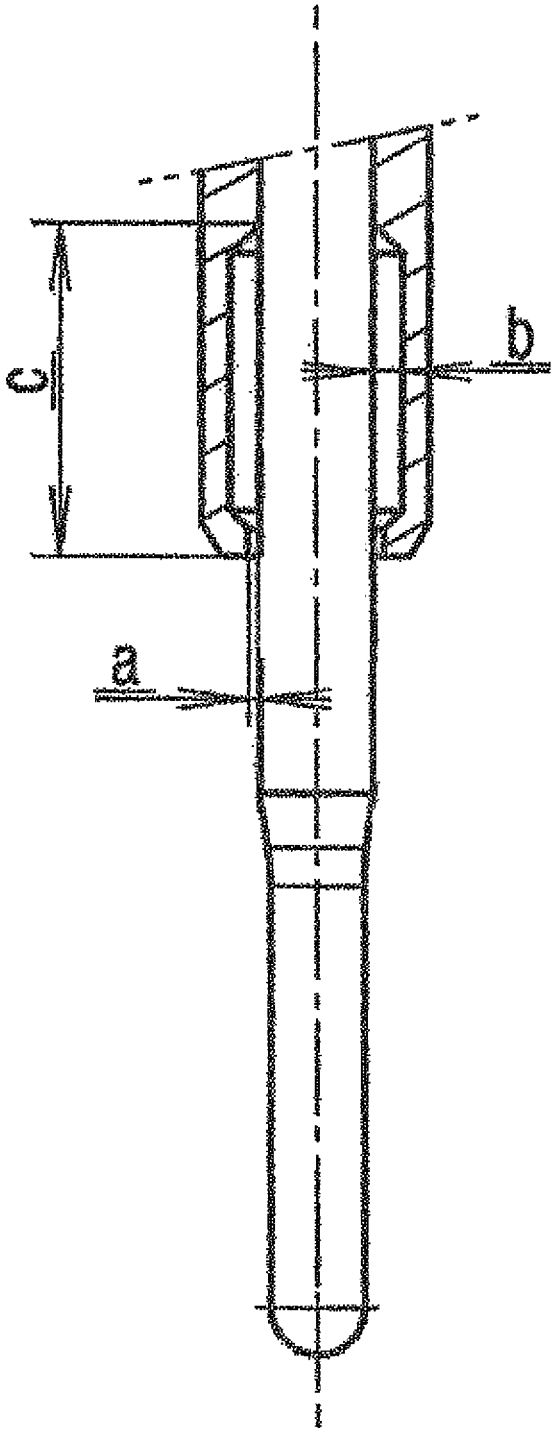
FIG. 5: shows the volume and annular gap

As seen in FIG. 5, the volume of the Helmholtz resonator consists of the annular gap volumes that are formed from b and c. FIG. 5 also shows that the radius of the Helmholtz pipe is derived from the measurements on the annular gap 3, whereby the internal length of the annular gap 3 corresponds to the length of the pipe 1, as given in the Helmholtz formula.

The gas exchange and the corresponding supply of oxygen containing combustion gas to the volume 4 and the annular gap 3 ensures that the temperatures in the annular gap 3 and the free space 4 increase to the extent that the carbon, particularly in the problematic contact zones, is burnt.

The effect can be strengthened with a specific and favorable coating of the surfaces using a material with catalytic effects. For example, a platinum coating is particularly advantageous here.

When samples were used in special continuous operations of engines and continuous sooting operations, no traces of carbon or carbon deposits were found in the annular gap 3 or in the empty space 4. The bellows, as shown in FIG. 6, too did not show any signs of soot or soot deposits after the continuous operations designed as per the invention.

In a favorable embodiment, at least one element (e.g. the bellows) has a coating and/or combination of materials containing a catalyst, so as to lower the ignition temperature for combustion residues.

Catalyst materials such as platinum and/or palladium, Auer metal, Raney nickel, rhodium, hopcalite, vanadium pentoxide and samarium oxide may be used, for example. Any other element of the described glow plug can also be coated with a catalyst. While making temperature measurements with the described configurations as per the invention, the temperatures, at which carbon burns without leaving behind any residues, were measured.

FIG. 2 shows a glow plug, which is arranged in a cylinder head 5 and has an annular gap 3 between the heating rod 1 and the body 2 of the glow plug and a chamber 4 adjacent to the annular gap 3, which communicates with the combustion chamber of the combustion engine through the annular gap 3 in such a way that oxygen containing gas reaches the chamber 4. This annular gap 3 and the empty space 4 enable a volume flow from the combustion chamber of the combustion engine to the chamber 4, which ensures a reliable gas exchange and thereby provides for a sufficient quantity of oxygen in the area of contact surfaces between the cylinder head and the glow plug. As a result, temperatures more than 600 degrees Celsius or lesser (if a corresponding catalyst surface is present) are achieved in the annular gap 3 and the empty space 4 via complete combustion. These high temperatures burn the carbon in this area and hence, the carbon does not get deposited in an area that is relevant for a smooth operation of the combustion engine.

Figure 3:
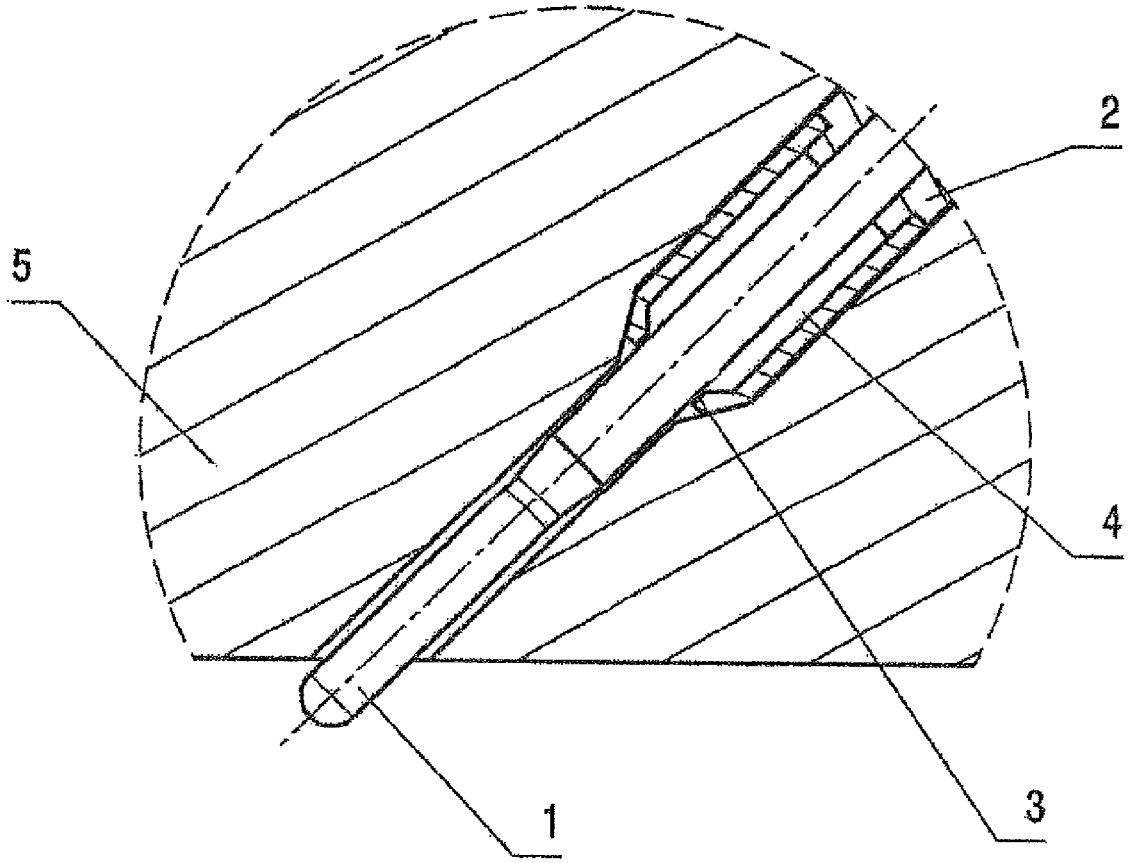
FIG. 3: shows the glow plug with varied volume and a two-part body

FIG. 3 shows a glow plug arranged in a cylinder head 5 and an annular gap 3 between the heating rod 1 and a two-part body 2 of the glow plug as well as a chamber 4 adjacent to the annular gap 3. This camber 4 is connected to the combustion chamber of the combustion engine through the annular gap 3 such that oxygen containing gas reaches the chamber 4. There is a possibility of a volume flow from the combustion chamber of the combustion engine into the chamber 4 through this annular gap 3 and the empty space 4, which ensures a reliable gas exchange and thereby provides for a sufficient quantity of oxygen in the area of contact surfaces between the cylinder head and the glow plug. Thus, very high temperatures are reached in the annular gap 3 and the empty space 4 due to oxidative processes. These high temperatures burn the carbon in this area and as a result, carbon does not get deposited in this area that is relevant for a smooth operation of the combustion engine.

Figure 4:
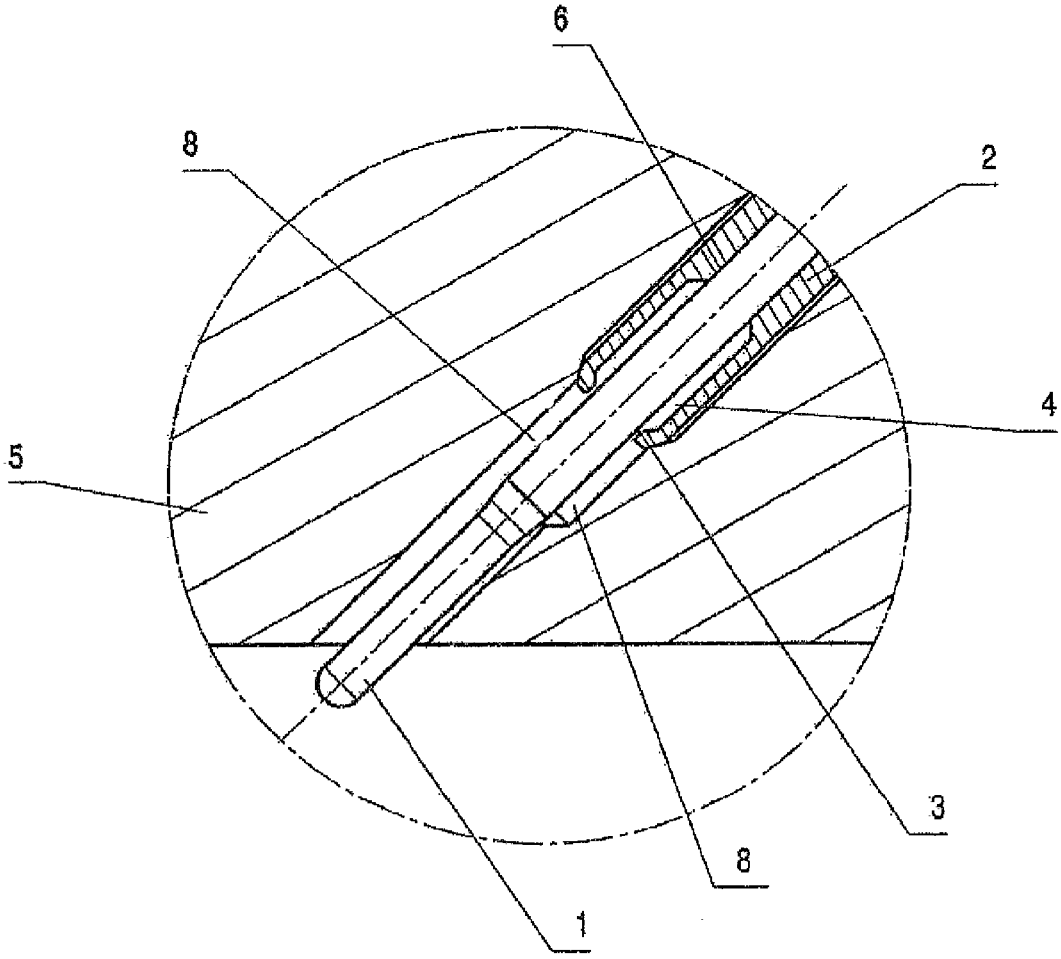
FIG. 4: shows the glow plug with volume in the cylinder head

FIG. 4 shows a glow plug arranged in a cylinder head 5 and an annular gap 3 between the heating rod 1 and the body 2 of the glow plug together with an additional chamber 8. The length of this chamber is to be added to the length of the pipe in the Helmholtz formula. The radius of the annular gap 3 corresponds to the radius of the pipe in the Helmholtz formula. The chamber 4 adjacent to the annular gap 3 communicates with the combustion chamber of the combustion engine through the annular gap 3 in such a way that oxygen containing gas reaches the chamber 4. There is a possibility of a volume flow from the combustion chamber of the combustion engine into the chamber 4 through this annular gap 3 and the empty space 4, in interaction with the chamber 8, whereby the volume flow ensures a reliable gas exchange and thereby provides for a sufficient quantity of oxygen in the area of contact surfaces between the cylinder head and the glow plug. As a result, temperatures more than 600 degrees Celsius are achieved in the annular gap 3 and the free space 4 via complete combustion. These high temperatures burn the carbon in this area and as a result, the carbon does not get deposited in an area that is relevant for a smooth operation of the combustion engine.

Figure 7:
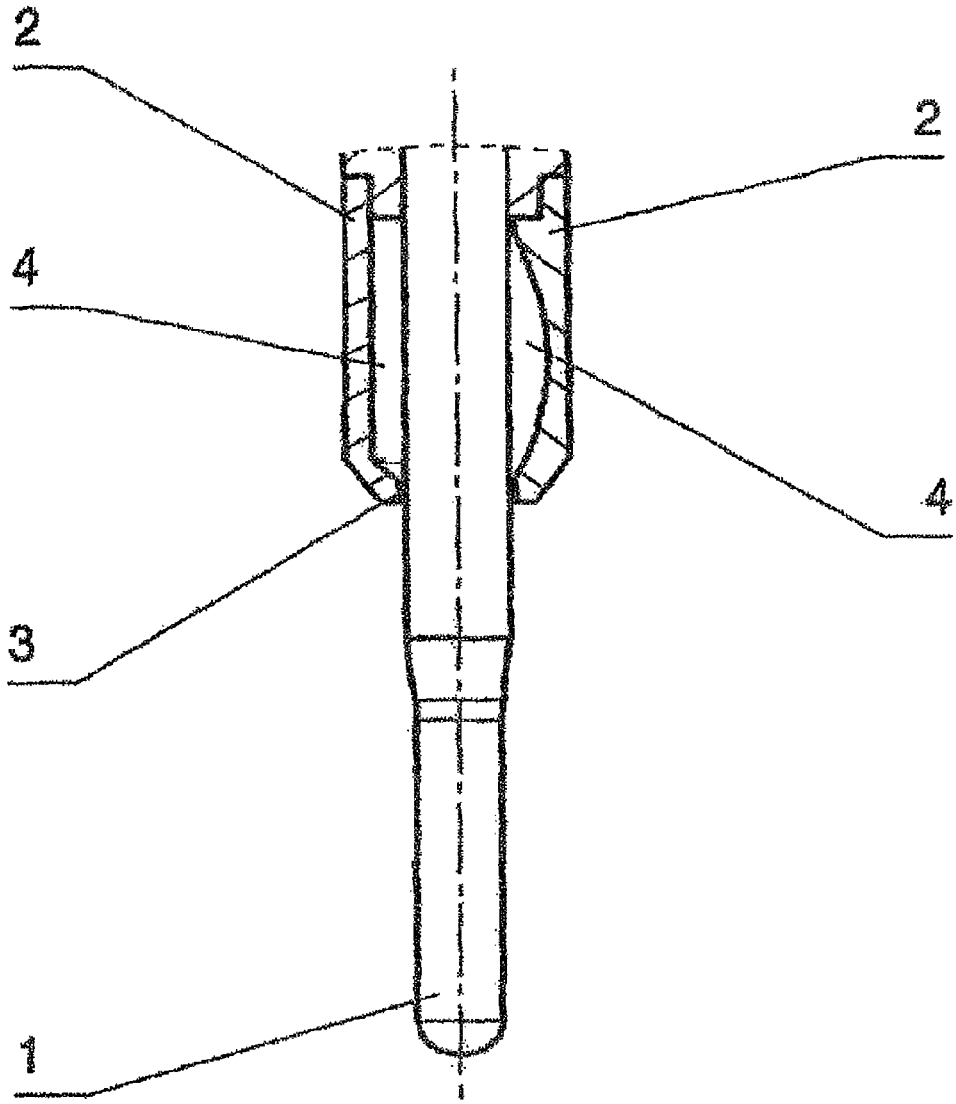
FIG. 7: shows a variant with a two-part body

An alternate design is shown in FIG. 7, in which the empty space 4 is created by the upper part (2) and lower part (2*a*) of a two-part body 2, 2*a*, whereby the body parts 2, 2*a* are arranged around the heating rod 1.

The body parts 2, 2*a* are joined with a weld seam 9.

FIG. 6 shows a movable heating rod 1 with a bellows 7, which forms a glow plug in a cylinder head 5 together with the body 2. There is an annular gap 3 between the body 2 and the heating rod 2. The bellows 7 are arranged in a chamber 4, such that they can move. The chamber 4 and the annular gap 3 are connected to the combustion chamber (of the combustion engine, which is also not shown explicitly) in the cylinder head 5. Because of the constant movement of the chamber 4 containing oxygenic combustion gas, a reliable oxidation of all the sooty particles (if any) is realized. Also, a carbonization in the area around the heating rod is avoided, particularly in the area of the annular gap 3 or in the chamber, in the beginning itself. An advantage of this is that the bellows remains mobile throughout the operating time of the glow plug.

Figure 8:
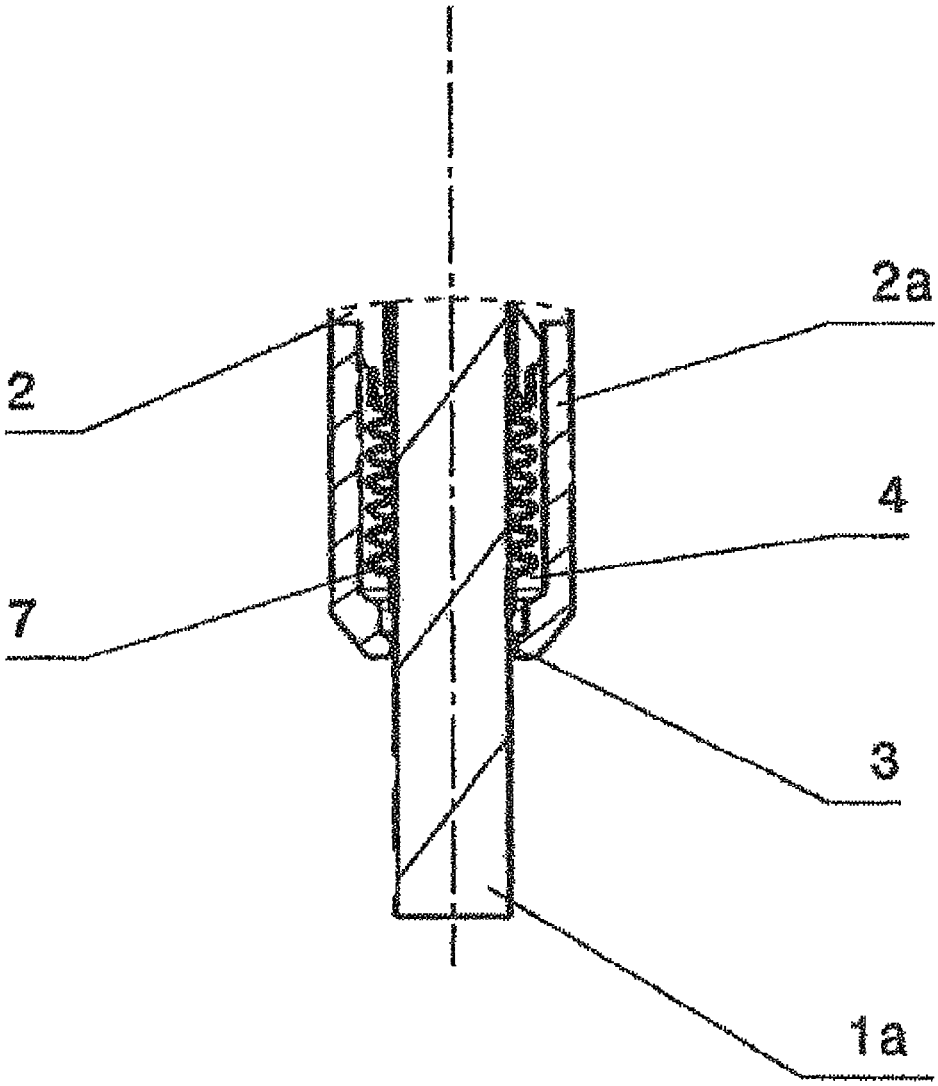
FIG. 8: shows a pressure sensor

FIG. 8 shows a pressure sensor, which (as shown in FIG. 6) is arranged in a cylinder head 5 of a combustion engine that is not shown explicitly. The pressure sensor comprises a two-piece housing 2, 2*a*, which may also be a one-piece housing as shown in FIG. 6. In a chamber 4, the bellows 7 are arranged between the housing 2 and pressure tappet 1*a*, such that the pressure tappet 1*a* together with the bellows 7 can be moved essentially along its longitudinal axis.

LIST OF REFERENCE NUMERALS

1. Heating rod
2. Body
2*a*. Lower part of the body
3. Annular gap
4. Chamber (volume/empty space)
5. Cylinder head
6. Press fit
7. Bellows
8. Chamber (volume/empty space)
9. Weld seam
a. Width of the annular gap
b. Width of the empty space
c. Length of the empty space

The invention claimed is:

1. Glow plug for a combustion engine, comprising at least one heating rod and at least one body and at least one annular gap between the heating rod and the body and at least one chamber partially arranged between the heating rod and the body, wherein a surface of the chamber has a coating containing a catalyst material, so as to lower ignition temperature for combustion residues, said catalyst material being selection from the group of materials consisting of Raney nickel, vanadium pentoxide, samarium oxide and hopcalite.

* * * * *